United States Patent [19]

Kanzler

[11] Patent Number: 4,941,221

[45] Date of Patent: Jul. 17, 1990

[54] BODY SUPPORTING APPARATUS

[75] Inventor: Graham L. B. Kanzler, 18 Ardeana Crescent, Albany, Australia

[73] Assignees: Ian Donald Butcher, Mandurah; Graham Leslie Bernard Kanzler, Albany, both of Australia

[21] Appl. No.: 327,912

[22] PCT Filed: Aug. 14, 1987

[86] PCT No.: PCT/AU87/00264

§ 371 Date: Feb. 14, 1989

§ 102(e) Date: Feb. 14, 1989

[87] PCT Pub. No.: WO88/01158

PCT Pub. Date: Feb. 25, 1988

[30] Foreign Application Priority Data

Aug. 15, 1987 [AU] Australia ..... PHO7453

[51] Int. Cl.[5] ..... A61G 7/06

[52] U.S. Cl. ..... 5/60; 5/61; 5/66; 5/80; 5/433; 5/446

[58] Field of Search ..... 5/60, 61, 66, 68, 80, 5/431–433, 443, 444, 446, 453, 455

[56] References Cited

U.S. PATENT DOCUMENTS

| | | | |
|---|---|---|---|
| 3,006,623 | 9/1971 | Aymar | 5/433 |
| 3,195,151 | 7/1965 | Boyer | 5/80 |
| 3,485,240 | 12/1986 | Fountain | 5/61 X |
| 3,678,520 | 7/1972 | Evans | 5/453 |
| 3,781,928 | 11/1974 | Swallert | 5/433 X |
| 4,127,906 | 12/1978 | Zur | 5/66 |
| 4,287,620 | 9/1981 | Fur | 5/68 |
| 4,517,693 | 5/1985 | Viesturs | 5/455 X |
| 4,639,960 | 2/1987 | Quillen et al. | 5/431 X |

*Primary Examiner*—Michael F. Trettel

*Attorney, Agent, or Firm*—Harness, Dickey & Pierce

[57] ABSTRACT

A body supporting apparatus which provides assistance to a person supported on the apparatus in moving between supine and reclining positions. The apparatus (10) comprises a supporting surface (13) having a longitudinal axis. The supporting surface (13) includes a plurality of sections (21,22,23 and 24) extending transversely of the longitudinal axis. The transverse sections are arranged for articulatory movement whereby the supporting surface (13) can assume a first attitude for supporting the body of a person in a generally supine position and a second attitude for supporting the body of a person in a reclining position with said first section (21) supporting the back of the body. The second section (22) supporting the posterior and thighs, the third section (23) supporting the lower legs and the fourth section (24) supporting the underside of the feet of the person.

14 Claims, 5 Drawing Sheets

BODY SUPPORTING APPARATUS

BACKGROUND OF THE INVENTION

This invention relates to a body supporting apparatus.

Persons who are bedridden may suffer great discomfort and anxiety owing to their confinement.

The discomfort may be alleviated to some extent periodically by moving the person between a supine position in which the person lies flat on his or her back and a reclining position in which the back of the person is elevated. Changing between supine and reclining positions is particularly troublesome for those persons who cannot move themselves and, in such cases, requires the aid of at least one attendant person. As the patient is required to be manhandled during such movement, the process may be painful for the patient and may expose the attendant person to risk of injury and, in particular back strain.

The anxiety generally arises from a state of helplessness which bedridden persons perceive to exist owing to their reliance on other people to assist them with various tasks including changes in position in bed.

The present invention seeks to provide a body supporting apparatus which provides assistance to a person supported on the apparatus in moving between supine and reclining positions, preferably to such an extent that such movement can be accomplished without assistance from another person.

SUMMARY OF THE INVENTION

One form the invention resides in a body supporting apparatus comprising a supporting surface having a longitudinal axis, the supporting surface including a first section extending transversely of the longitudinal axis, said first section being arranged for articulatory movement whereby the supporting surface can assume a first attitude for supporting the body of a person in a generally supine position and a second attitude for supporting the body of a person in a reclining position with said first section supporting the back of the body, and means for effecting articulatory movement of said first section.

Preferably, the supporting surface includes a second section extending transversely of the longitudinal axis, said second section being located adjacent said first section and arranged for articulatory movement relative thereto whereby when the supporting surface assumes said second attitude said second section is arranged to support the posterior and thighs of the body, and wherein said means for effecting articulatory movement of said first section also effects articulatory movement of said second section.

Preferably, said means for effecting articulatory movement of said sections is operable pneumatically. Such pneumatically operable means may comprise a first inflatable chamber positioned between said first section and an understructure and a second inflatable chamber positioned between said second section and said understructure, and further comprising means for selectively admitting and expelling pneumatic fluid into and from said inflatable chambers.

Preferably, said supporting surface further includes a third section for supporting the lower legs of the body of a person occupying the apparatus when the supporting surface assumes said second attitude.

Preferably, said supporting surface further includes a fourth section for supporting the underside of the feet of the body of a person occupying the apparatus when the supporting surface assumes said second attitude.

Preferably, said pneumatically operable means includes a further inflatable chamber positioned between the fourth section and said understructure.

Preferably, the fourth transverse section of the support surface is linked to said second transverse section so that the fourth transverse section is drawn towards the second transverse section on articulatory movement of the transverse sections when the support surface moves from the first attitute to the second attitude.

Preferably, the inflatable chambers are each in the form of a bellows.

In addition to enabling the body of a person to be moved between supine and reclining positions, it is desirable that the person be periodically moved from the supine position into one side position and then into the other side position. For patients who cannot turn over by themselves, such changes in body position are extremely troublesome and require the aid of several attendant persons if the change is to be comfortably made.

Preferably, the body supporting apparatus according to the invention includes means which facilitate such positional changes of the body to be made. To this end, said supporting surface may include a central longitudinal section and two marginal longitudinal sections, and a longitudinal inflatable chamber positioned between each longitudinal section and said understructure whereby inflation of each longitudinal inflatable chamber causes the respective marginal portion to articulate upwardly relative to the central section. The upward articulatory movement of either one of the marginal sections facilitates a positional change of a person occupying the body supporting apparatus.

BRIEF DESCRIPTION OF THE DRAWINGS

The invention will be better understood by reference to the following description of one specific embodiment thereof as shown in the accompanying drawings in which.

DETAILED DESCRIPTION OF THE PREFERRED EMBODIMENTS

Figure 1:
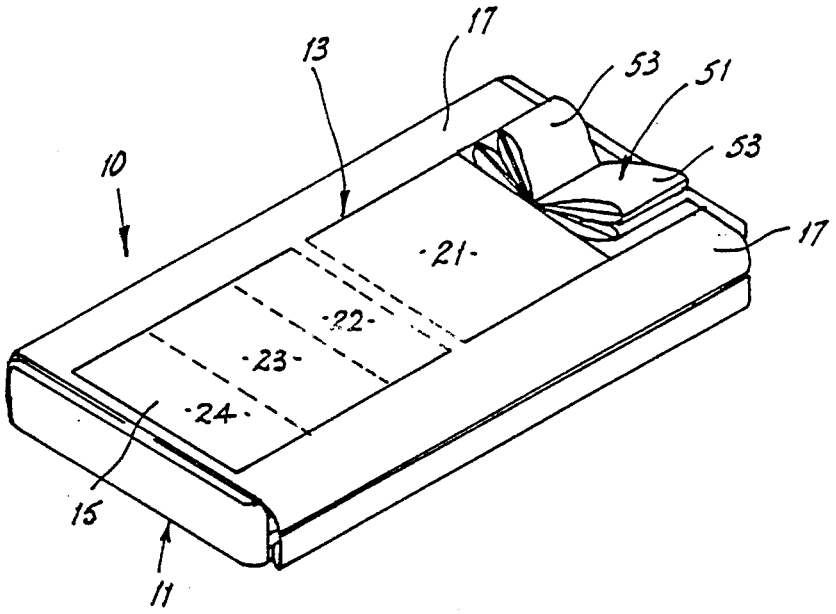
FIG. 1 is a schematic perspective view of a body supporting apparatus according to the embodiment fitted on to a mattress, with the supporting surface of the apparatus shown in a first attitude.

The embodiment shown in the drawings is directed to a body supporting apparatus which is used in conjunction with a conventional bed mattress. The body supporting apparatus is indicated generally by referene numeral 10 and is adapted to be removably fitted onto the mattress 11 in a manner to be explained later.

The apparatus 11 allows a person who is confined to a bed and who would be otherwise incapable of changing position in the bed without aid from an attendant person, to move betweem supine and reclining positions and also to move between the supine position and one or the other side position.

The apparatus 10 comprises a body supporting surface 13 which includes a central longitudinal section 15 and two marginal longitudinal sections 17.

The body supporting surface 13 further includes a plurality of sections extending transversely of the longitudinal axis of the supporting surface 13, there being a first section 21, a second section 22, a third section 23 and a fourth sections 24. The transverse sections are centrally located on the support surface 13 and extend part of the way across that surface so as to occupy the central longitudinal section 15 and a portion of each marginal longitudinal section 17 of the support surface 13.

Figure 3:
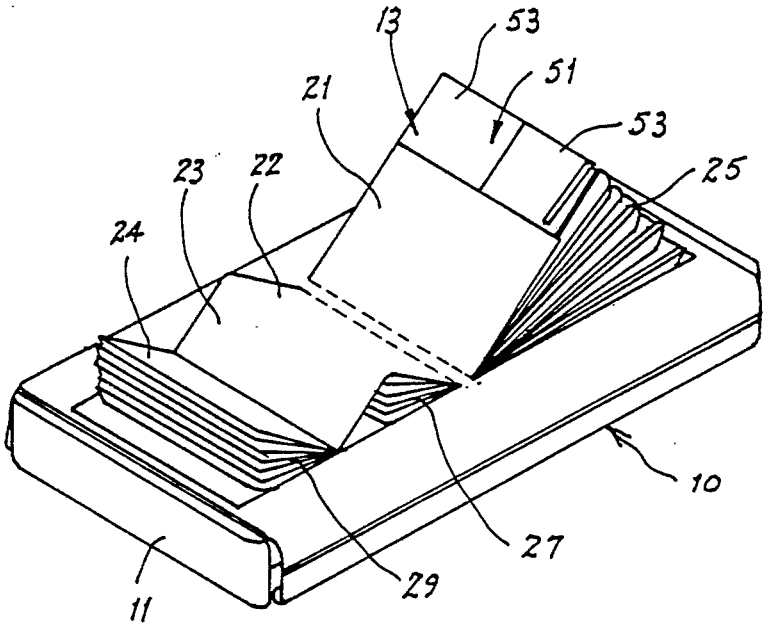
FIG. 3 is a view similar to FIG. 1 with the exception that the support surface is shown in a second attitude.
Figure 2:
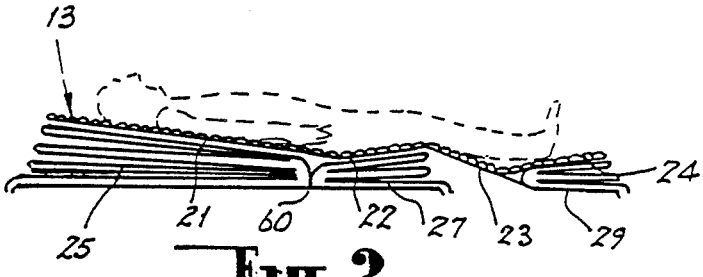
FIG. 2 is a schematic side view of part of the apparatus of FIG. 1, with a body (shown in outline) supported in a generally supine position.
Figure 4:
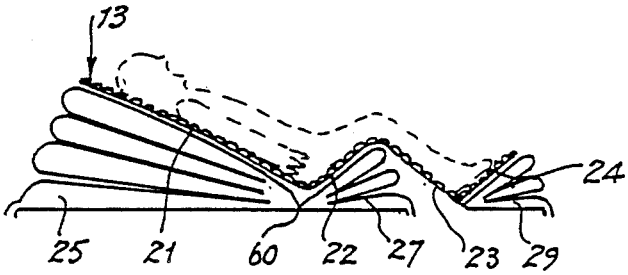
FIG. 4 is schematic side view of part of the body supporting apparatus of FIG. 3, with a body (shown in outline) supported in a reclining position.

The transverse sections are each arranged for articulatory movement relative to the next adjacent section, whereby the supporting surface 13 can assume a first attitude (as shown in FIGS. 1 and 2 of the drawings) for supporting an occupant of the bed in a supine position and a second attitude (as shown in FIGS. 3 and 4) for supporting the occupant in a reclining position. When the supporting surface assumes the second attitude (in which the occupant is reclined for comfortable repose) the first transverse section 21 supports the back and head of the occupant, the second transverse section 22 supports the posterior and thighs, the third transverse section 23 supports the lower legs and the fourth transverse section 24 supports the underside of the feet of the occupant.

The supporting surface 13 can assume further attitudes in which either one or both of the marginal longitudinal sections 17 are articulated to assume an upwardly and outwardly inclined configuration which can assist the occupant in moving between supine and side positions in the bed.

A pneumatic means is provided to selectively cause the supporting surface to assume the various attitudes described above. The pneumatic means includes three transverse inflatable chambers 25, 27 and 29 respectively and two longitudinal inflatable chambers 31.

The two longitudinal inflatable chambers 31 are attached to a mattress cover 33 fitted to the mattress 11. The mattress cover 33 includes a top panel 34 and two longitudinal side panels 35 to each of which a respective one of the longitudinal inflatable chambers is releasably attached. The longitudinal inflatable chambers 31 rest on the top panel 34 of the mattress cover 33 one adjacent each longitudinal side thereof. Each longitudinal inflatable chamber 31 includes a portion 36 which drapes over the side of the mattress for releasable attachment at 37 to the adjacent longitudinal side panel 35. While the attachment between each longitudinal inflatable chamber 31 and the adjacent longitudinal side panel 35 may be accomplished in any suitable manner, a zipper fastener has been found to be particularly suitable. With such an arrangement, one set of teeth of the zipper fastener is attached to the side panel 35 and the other set of teeth is attached to the draping portion 36 of the longitudinal inflatable chamber.

The three transverse inflatable chambers 25, 27 and 29 are positioned on top of the two longitudinal inflatable chambers 31 but are not attached thereto. Specifically, the transverse inflatable chambers are positioned so as to bridge the two longitudinal inflation chambers 31 and are so arranged that one of the transverse inflatable chambers is located respectively below the first, second and fourth transverse sections of the supporting surface 13. More particularly, the first transverse inflatable chamber 25 is located below the first transverse section 21 of the supporting surface 13, the second transverse inflatable chamber 27 is located below the second transverse section 22 of the supporting surface, and the third transverse inflatable chamber 29 is located below the fourth transverse section 24 of the supporting surface (there being no inflatable chamber positioned below the third section 23 of the supporting surface).

The transverse inflatable chambers 25, 27 and 29 are each configured in the form of a bellows which when deflated assumes a substantially flat condition and when inflated assumes a generally triangular condition in side view for supporting the corresponding transverse section of the supporting surface 13 at the required angular position.

The first and second transverse inflatable chambers 25 and 27 respectively are secured together at 60 and the third transverse inflatable chamber 29 is remote from the second transverse inflatable chamber.

Figure 5:
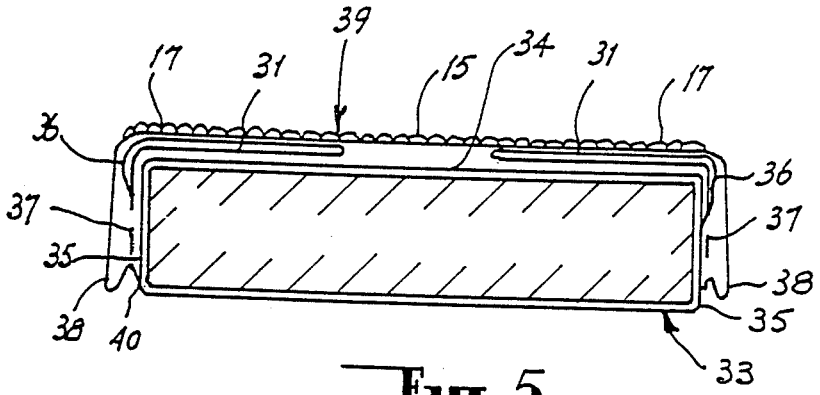
FIG. 5 is a schematic end view of the body supporting apparatus in the position shown in FIG. 1.
Figure 6:
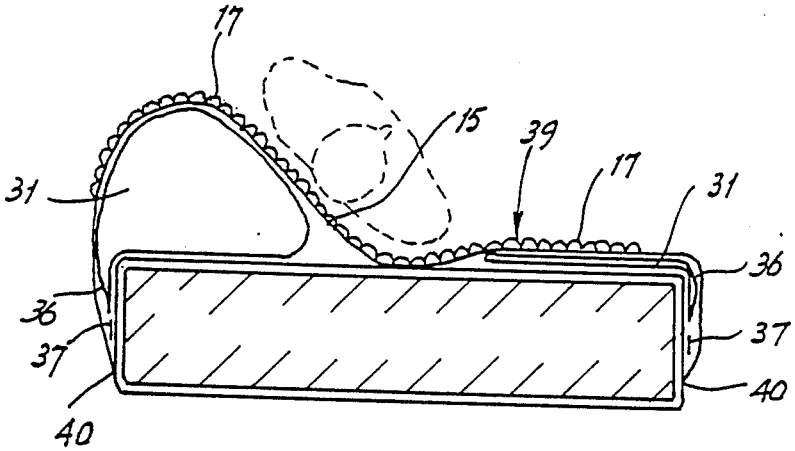
FIG. 6 is an end view similar to FIG. 5 with the exception that one marginal longitudinal section of the supporting surface is shown in an elevated position.
Figure 7:
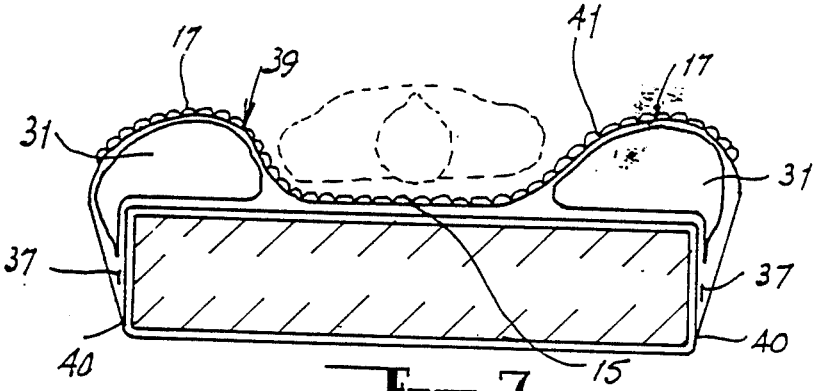
FIG. 7 is a view similar to FIG. 6 with the exception that both marginal longitudinal sections of the supporting surface are shown in elevated positions.

As previously mentioned, the transverse inflatable chambers 25, 27 and 29 merely rest on the longitudinal inflatable chambers 31 and are not fastened to them. Each transverse inflatable chamber is however releasably fastened to the underside of a flexible covering 39 which overlies the various longitudinal and transverse inflatable chambers and drapes down alongside the longitudinal sides of the mattress 11. The longitudinal egdes of the flexible covering 39 are releasably fastened to the longitudinal sides 35 of the mattress cover 33 at a location 40 below location 37 at which the adjacent longitudinal inflatable chamber 31 is attached to the longitudinal side panel 35. The flexible covering 39 includes sufficient surplus material to accommodate spreading of the covering when one or both of the longitudinal inflatable chambers 31 are fully inflated. When the two longitudinal inflatable chambers are in a deflated condition, the surplus material lays loosely adjacent the longitudinal sides of the mattress, as best seen in FIG. 5 of the drawings where the surplus material is indicated generally by reference numeral 38.

Figure 13:
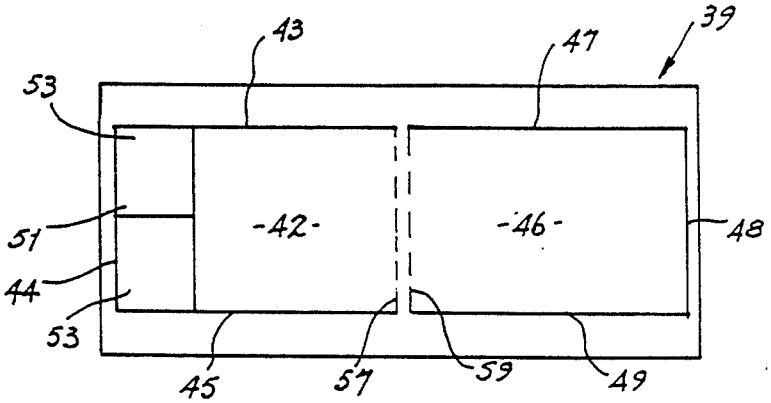
FIG. 13 is a schematic plan view of a flexible covering which provides a body supporting surface of the apparatus.

The flexible covering 39 may be of any suitable construction, but preferably includes a portion 41 of sheepskin or other fibrous material which provides said body supporting surface 13. The four transverse sections 21, 22, 23 and 24 of the supporting surface 13 are formed by appropriately cutting the flexible covering 39. More particularly, the first transverse section 21 is provided by a flap 42 formed by cut lines 43, 44 and 45 in the flexible covering, as best seen in FIG. 13 of the drawings. The flap 42 so formed remains anchored to the remainder of the flexible covering at hinge line 57 which extends between the free ends of cut lines 43 and 45.

The second, third and fourth transverse sections are of integral construction and are provided by a further flap 46 formed by cut lines 47, 48 and 49 in the flexible covering, also as best seen in FIG. 13 of the drawings. The further flap 46 so formed remains anchored to the remainder of the flexible covering at hinge line 59 which extends between the free ends of the cut lines 47 and 49.

As previously mentioned, the transverse inflatable chambers are releasably fastened to the underside of the flexible covering 39. More particularly the first transverse inflatable chamber 25 is fastened to the underside of flap 42 and the second and third transverse inflatable chambers 27 and 29 respectively are fastened to the underside of flap 46. With this arrangement, the flap 46 links the second and third transverse inflatable chambers such that on inflation of the second inflatable chamber, 27 the third inflatable chamber 29 is drawn towards the second inflatable chamber, as is evident when FIG. 4 of the drawings is compared to FIG. 2 of the drawings.

The pneumatic means includes a control system to selectively admit and expel inflation fluid to and from the transverse inflatable chambers such that those chambers operate as a unit and to also selectively admit and expel inflation fluid to and from either one or both of the longitudinal inflation chambers. The inflation fluid may comprise any suitable gas such as nitrogen or a gaseous mixture such as air. The control system is preferably voice actuated so that a person supported in apparatus according to the embodiment can initiate change in the attitude of the support surface without manual effort.

Figure 8:
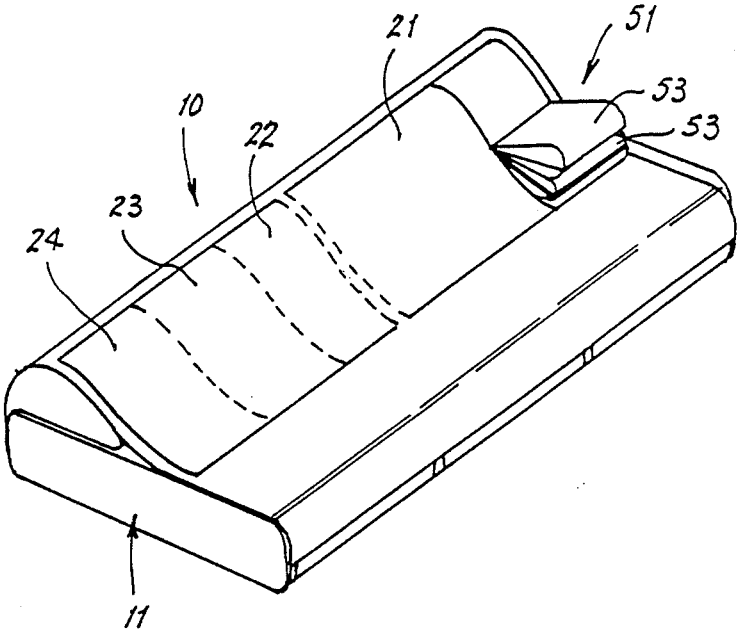
FIG. 8 is a schematic perspective view of the body supporting apparatus in the position shown in FIG. 6.
Figure 9:
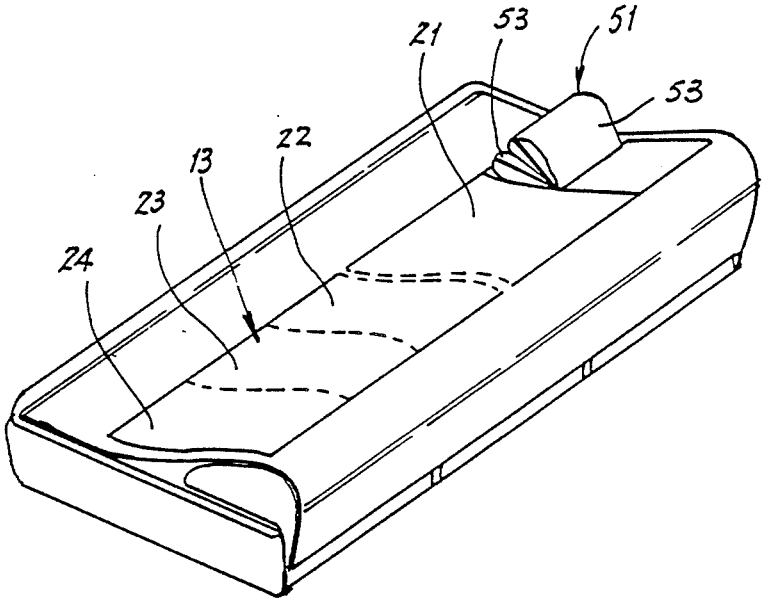
FIG. 9 is a view similar to FIG. 8 with the exception that the other longitudinal marginal section of the supporting surface is elevated.
Figure 10:
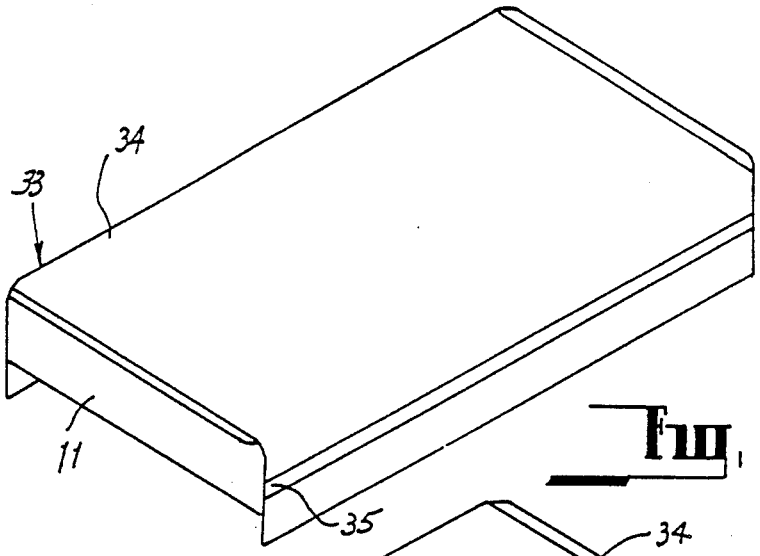
FIG. 10 is a perspective view of a mattress with part of the apparatus according to the embodiment fitted in position.
Figure 11:
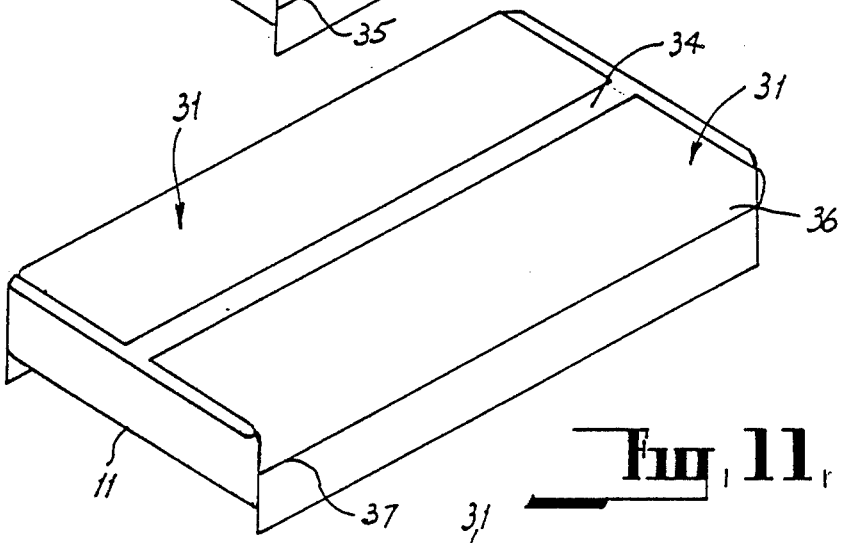
FIG. 11 is a view similar to FIG. 10 with the exception that a further part of the apparatus is shown fitted in position.
Figure 12:
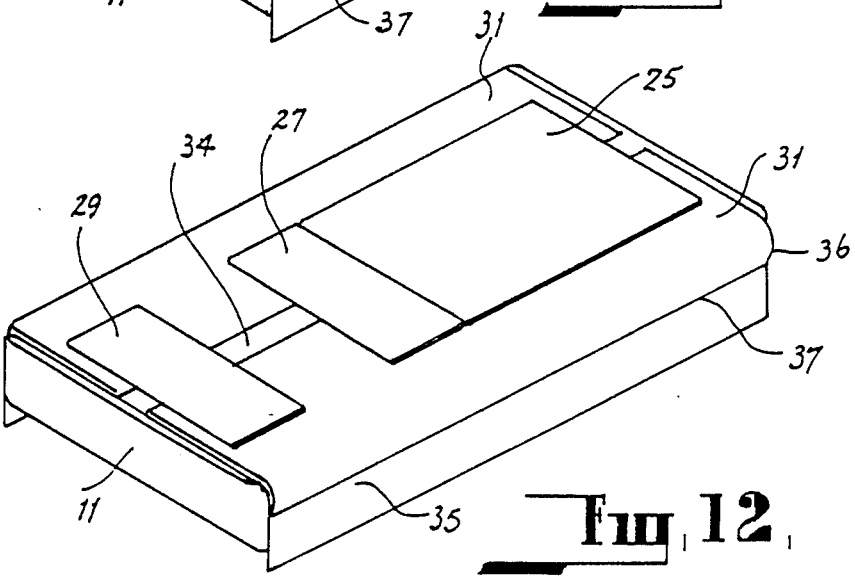
FIG. 12 is a still further perspective view similar to FIG. 10 with the exception that a still further part of the apparatus is shown fitted in position.

The first transverse section 21 of the body supporting surface 13 is provided with an inflatable head rest 51 which is adapted to provide lateral support for the head of the occupant. The head rest 51 comprises a pair of spaced leaves 53 each of which is inflatable. When the support surface 13 assumes the second attitude, the leaves are folded in opposite directions (as best seen in FIG. 3) so as to provide lateral support for each side of the head of the occupant. When one of the longitudinal marginal sections of the supporting surface is elevated, both of the leaves 53 are folded in the same direction (as best seen in FIGS. 8 and 9.) to provide lateral support for the downward side of the head of the occupant.

In use, the apparatus according to the embodiment can be employed to assist a bedridden person supported by the apparatus to change position in bed. With appropriate vocal instructions, the bedridden person can initiate changes in the attitude of the supporting surface 13 of the apparatus which in turn allows the person to change position in bed. The changes in attitude of the supporting surface are brought about by introduction of inflation fluid into, or expulsion of inflation fluid from, one or more of the inflatable chambers. If, for example, a person lying in a supine position (as shown in FIG. 2) wishes to assume a reclining position (as shown in FIG. 4), the person actuates the control system by appropriate vocal instructions so as to cause inflation fluid to inflate the three transverse inflatable chambers 25, 29 and 29. Inflation of those chambers changes the supporting surface from the first attitude to the second attitude and this brings about the required change in the body position of the person. As the supporting surface changes attitude, the third inflatable chamber 29 is drawn towards the second inflatable chamber 27 so as to bring the fourth transverse section 24 into an appropriate position to support the underside of the feet of the occupant. When the person wishes to return to the supine position, the control system is initiated to cause controlled expulsion of inflation fluid from the transverse inflatable chambers. As the chambers deflate, the action of the weight of the person's feet on the fourth transverse section 24 serves to move the third inflatable in the direction away from the second inflatable chamber.

If the person whishes to change from the supine position to a side position, the control system is initiated so as to cause inflation of the particular longitudinal inflatable chamber 31 opposite to the side to which the person wishes to turn and so elevate the respective marginal longitudinal section 17 of the supporting surface. Elevation of the marginal longitudinal section assists the person in rolling towards the other side so as to assume the desired side position. When the person wishes to return to the supine position, assistance may be obtained by elevating the other marginal longitudinal section. Furthermore, both marginal longitudinal sections may be elevated to centralise the position of the person in bed.

The apparatus according to the embodiment is so constructed that the flexible covering 39 is readily detachable for laundering.

I claim:

1. A body supporting apparatus comprising a supporting surface defined by a flexible covering having a longitudinal axis, the supporting surface including a central longitudinal section and two marginal longitudinal sections and a longitudinal inflatable chamber positioned beneath each marginal longitudinal section whereby inflation of each longitudinal inflatable chamber causes the respective marginal section to articulate upwardly relative to the central section, the support surface further including a first transverse section extending transversely of the longitudinal axis, said first transverse section being arranged for articulatory movement whereby the supporting surface can assume a first attitude for supporting the body of a person in a generally supine position and a second attitude for supporting the body of a person in a reclining position with said first transverse section supporting the back of the body, and means for effecting articulatory movement of said first transverse section including a first transverse inflatable chamber positioned between said first transverse section and the longitudinal inflatable chambers.

2. A body supporting apparatus according to claim 1 wherein the supporting surface further includes a second transverse section extending transversely of the longitudinal axis, said second transverse section being located adjacent said first transverse section and arranged for articulatory movement relative thereto whereby when the supporting surface assumes said second attitude, said second transverse section being arranged to support the posterior and thighs of the body, and wherein said means for effecting articulatory movement of said first section also effects articulatory movement of said second section and includes a second transverse inflatable chamber positioned between said second transverse section and the longitudinal inflatable chambers.

3. A body supporting apparatus according to claim 2, wherein said supporting surface further includes a third transverse section for supporting the lower legs of the body of a person occupying the apparatus when the supporting surface assumes said second attitude.

4. A body supporting apparatus according to claim 3 wherein said supporting surface further includes a fourth transverse section for supporting the underside of the feet of the body of a person occupying the apparatus when the supporting surface assumes said second attitude.

5. A body supporting apparatus according to claim 4 wherein said means for effecting articulatory movement of said sections is operable pneumatically and said pneumatically operable means includes a further transverse inflatable chamber positioned between the fourth section and said longitudinal inflatable chambers.

6. A body supporting apparatus according to claim 5 wherein the fourth transverse section of the support surface is linked to said second transverse section so that the fourth transverse section is drawn towards the second transverse section on articulatory movement of the transverse sections when the support surface moves from the first attitude to the second attitude.

7. A body supporting apparatus according to claim 1 wherein said means for effecting articulatory movement of said sections is operable pneumatically.

8. A body supporting apparatus according to claim 7 wherein said pneumatically operable means includes means for selectively admitting and expelling pneumatic fluid into and from said inflatable chambers.

9. A body supporting apparatus according to claim 1, wherein the inflatable chambers are each in the form of a bellows.

10. A body supporting apparatus as claimed in claim 1 wherein the supporting surface is defined by a flexible covering.

11. A body supporting apparatus as claimed in claim 10 wherein each transverse inflatable chamber is attached to the underside of the flexible covering.

12. A body supporting apparatus according to claim 11 wherein the longitudinal sides of said flexible covering are connected to an understructure, there being sufficient surplus material in the flexible covering to accommodate inflation of the longitudinal inflatable chambers.

13. A body supporting apparatus as claimed in claim 12 wherein said understructure includes a mattress on which the longitudinal inflatable chambers are supported.

14. A body supporting apparatus according to claim 13 wherein first and second flaps are formed in the flexible covering, the flaps each having a hinge line at which it remains attached to the remainder of the flexible covering, said hinge lines extending transversely of said longitudinal axis and being adjacent each other, the first flap defining said first transverse section and the second flap defined the transverse sections other than said first transverse section.

* * * * *